US007762341B2

(12) United States Patent
Hammer

(10) Patent No.: US 7,762,341 B2
(45) Date of Patent: Jul. 27, 2010

(54) FLOW CONTROL DEVICE UTILIZING A REACTIVE MEDIA

(75) Inventor: Aaron C. Hammer, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/120,128

(22) Filed: May 13, 2008

(65) Prior Publication Data

US 2009/0283275 A1 Nov. 19, 2009

(51) Int. Cl.
*E21B 43/00* (2006.01)
*E21B 33/12* (2006.01)

(52) U.S. Cl. ..... 166/370; 166/187; 166/207

(58) Field of Classification Search ..... 166/227, 166/386, 316, 319, 387, 380, 383, 77.4, 153–156
See application file for complete search history.

(56) References Cited

U.S. PATENT DOCUMENTS

| | | | |
|---|---|---|---|
| 1,362,552 | A | 12/1920 | Alexander et al. |
| 1,649,524 | A | 11/1927 | Hammond |
| 1,915,867 | A | 6/1933 | Penick |
| 1,984,741 | A | 12/1934 | Harrington |
| 2,089,477 | A | 8/1937 | Halbert |
| 2,119,563 | A | 6/1938 | Wells |
| 2,214,064 | A | 9/1940 | Niles |
| 2,257,523 | A | 9/1941 | Combs |
| 2,412,641 | A | 12/1946 | Spangler |
| 2,762,437 | A | 9/1956 | Egan et al. |
| 2,610,352 | A | 10/1957 | Tumilson |
| 2,814,947 | A | 12/1957 | Stegemeier |
| 2,942,668 | A * | 6/1960 | Maly et al. ..... 166/185 |

(Continued)

FOREIGN PATENT DOCUMENTS

| | | |
|---|---|---|
| CN | 1385594 | 12/2002 |

(Continued)

OTHER PUBLICATIONS

Optimization of Commingled Production Using Infinitely Variable Inflow Control Valves; M.M., J. J. Naus, Delft University of Technology (DUT), Shell International Exploration and production (SIEP): J.D. Jansen, DUT and SIEP; SPE Annual Technical Conference and Exhibition, Sep. 26-29 Houston, Texas. 2004, Society of Patent Engineers.

(Continued)

*Primary Examiner*—Daniel P Stephenson
*Assistant Examiner*—Yong-Suk Ro
(74) *Attorney, Agent, or Firm*—Mossman, Kumar & Tyler, PC

(57) ABSTRACT

An apparatus for controlling a flow of a fluid into a wellbore tubular includes a flow path associated with a production control device; an occlusion member positioned along the flow path that selectively occludes the flow path, and a reactive media disposed along the flow path that change a pressure differential across at least a portion of the flow path by interacting with a selected fluid. The reactive media may be a water swellable material or an oil swellable material. The reactive media may be selected or formulated to change a parameter related to the flow path. Illustrative parameters include, but are not limited to, (i) permeability, (ii) tortuosity, (iii) turbulence, (iv) viscosity, and (v) cross-sectional flow area.

21 Claims, 7 Drawing Sheets

U.S. PATENT DOCUMENTS 2,945,541 A * 7/1960 Maly et al. ..... 166/185
3,326,291 A 6/1967 Zandmer
3,385,367 A 5/1968 Kollsman
3,419,089 A 12/1968 Venghiattis
3,451,477 A 6/1969 Kelley
3,675,714 A 7/1972 Thompson
3,739,645 A 6/1973 Berry et al.
3,791,444 A 2/1974 Hickey
3,876,471 A 4/1975 Jones
3,918,523 A 11/1975 Stuber
3,951,338 A 4/1976 Genna
4,173,255 A 11/1979 Kramer
4,180,132 A 12/1979 Young
4,186,100 A 1/1980 Mott
4,250,907 A 2/1981 Struckman et al.
4,257,650 A 3/1981 Allen
4,287,952 A 9/1981 Erbstoesser
4,415,205 A 11/1983 Rehm et al.
4,434,849 A 3/1984 Allen
4,491,186 A 1/1985 Alder
4,497,714 A 2/1985 Harris
4,552,218 A * 11/1985 Ross et al. ..... 166/319
4,572,295 A 2/1986 Walley
4,614,303 A 9/1986 Moseley, Jr. et al.
4,649,996 A 3/1987 Kojicic et al.
4,821,800 A 4/1989 Scott et al.
4,856,590 A 8/1989 Caillier
4,917,183 A 4/1990 Gaidry et al.
4,974,674 A 12/1990 Wells
4,998,585 A 3/1991 Newcomer et al.
5,004,049 A 4/1991 Arterbury
5,156,811 A * 10/1992 White ..... 422/100
5,333,684 A 8/1994 Walter et al.
5,337,821 A 8/1994 Peterson
5,339,895 A 8/1994 Arterbury et al.
5,377,750 A 1/1995 Arterbury et al.
5,381,864 A 1/1995 Nguyen et al.
5,431,346 A 7/1995 Sinaisky
5,435,393 A 7/1995 Brekke et al.
5,435,395 A 7/1995 Connell
5,439,966 A 8/1995 Graham et al.
5,551,513 A 9/1996 Surles et al.
5,586,213 A 12/1996 Bridges et al.
5,597,042 A 1/1997 Tubel et al.
5,609,204 A 3/1997 Rebardi et al.
5,673,751 A 10/1997 Head et al.
5,803,179 A 9/1998 Echols
5,831,156 A 11/1998 Mullins
5,839,508 A 11/1998 Tubel et al.
5,873,410 A 2/1999 Iato et al.
5,881,809 A 3/1999 Gillespie et al.
5,982,801 A 11/1999 Deak
6,068,015 A 5/2000 Pringle
6,112,815 A 9/2000 Boe et al.
6,112,817 A 9/2000 Voll
6,228,812 B1 5/2001 Dawson et al.
6,253,847 B1 7/2001 Stephenson
6,253,861 B1 7/2001 Carmichael et al.
6,273,194 B1 8/2001 Hiron
6,305,470 B1 10/2001 Woie
6,367,547 B1 4/2002 Towers et al.
6,371,210 B1 4/2002 Bode et al.
6,372,678 B1 4/2002 Youngman et al.
6,419,021 B1 7/2002 George et al.
6,474,413 B1 11/2002 Barbosa et al.
6,505,682 B2 1/2003 Brockman
6,516,888 B1 2/2003 Gunnarson et al.
6,581,682 B1 * 6/2003 Parent et al. ..... 166/180
6,622,794 B2 9/2003 Zisk
6,632,527 B1 10/2003 McDaniel et al.
6,635,732 B2 10/2003 Mentak
6,667,029 B2 12/2003 Zhong et al.
6,679,324 B2 1/2004 Boer et al.
6,692,766 B1 2/2004 Rubinstein et al.
6,699,503 B1 3/2004 Sako et al.
6,699,611 B2 3/2004 Kim et al.
6,786,285 B2 9/2004 Johnson et al.
6,817,416 B2 11/2004 Wilson et al.
6,840,321 B2 1/2005 Restarick et al.
6,863,126 B2 3/2005 McGlothen et al.
6,938,698 B2 9/2005 Coronado
6,951,252 B2 10/2005 Restarick et al.
6,976,542 B2 12/2005 Henriksen et al.
7,084,094 B2 8/2006 Gunn et al.
7,159,656 B2 1/2007 Eoff et al.
7,185,705 B2 3/2007 Freyer
7,318,472 B2 1/2008 Smith
7,322,412 B2 1/2008 Badalamenti et al.
7,325,616 B2 2/2008 Lopez de Cardenas et al.
7,395,858 B2 7/2008 Barbosa et al.
7,409,999 B2 8/2008 Henriksen et al.
2002/0125009 A1 9/2002 Wetzel et al.
2003/0221834 A1 12/2003 Hess et al.
2004/0052689 A1 3/2004 Yao
2004/0144544 A1 7/2004 Freyer
2004/0194971 A1 10/2004 Thomson
2005/0016732 A1 1/2005 Brannon et al.
2005/0126776 A1 6/2005 Russell
2005/0171248 A1 8/2005 Li et al.
2005/0178705 A1 8/2005 Broyles et al.
2005/0189119 A1 9/2005 Gynz-Rekowski
2005/0199298 A1 9/2005 Farrington
2005/0207279 A1 9/2005 Chemali et al.
2005/0241835 A1 11/2005 Burris et al.
2006/0048936 A1 3/2006 Fripp et al.
2006/0048942 A1 3/2006 Moen et al.
2006/0076150 A1 4/2006 Coronado
2006/0086498 A1 4/2006 Wetzel et al.
2006/0108114 A1 5/2006 Johnson
2006/0133089 A1 6/2006 Reid et al.
2006/0185849 A1 8/2006 Edwards et al.
2006/0272814 A1 12/2006 Broome et al.
2007/0039741 A1 2/2007 Hailey
2007/0044962 A1 3/2007 Tibbles
2007/0131434 A1 6/2007 MacDougall et al.
2007/0246210 A1 10/2007 Richards
2007/0246225 A1 * 10/2007 Hailey et al. ..... 166/386
2008/0035350 A1 2/2008 Henriksen et al.
2008/0053662 A1 3/2008 Williamson et al.
2008/0135249 A1 6/2008 Fripp et al.
2008/0149323 A1 6/2008 O'Malley et al.
2008/0149351 A1 6/2008 Marya et al.
2008/0236839 A1 10/2008 Oddie
2008/0236843 A1 10/2008 Scott et al.
2008/0283238 A1 11/2008 Richards et al.

FOREIGN PATENT DOCUMENTS

GB 1492345 11/1977
GB 2341405 12/2007
JP 59089383 B2 5/1984
SU 1335677 A 9/1987
WO 9403743 A1 2/1994
WO WO 00/79097 5/2000
WO WO 01/65063 2/2001
WO WO 01/77485 3/2001
WO WO 02/075110 9/2002
WO 2004018833 A1 3/2004
WO WO 2005/015277 7/2005

OTHER PUBLICATIONS

An Oil Selective Inflow Control System; Rune Freyer, Easy Well Solutions; Morten Fejerskkov, Norsk Hydro; Arve Huse, Altinex; European Petroleum Conference. Oct. 29-31, Aberdeen, United Kingdom, Copyright 2002, Society of Petroleum Engineers, Inc.

Determination of Perforation Schemes to Control Production and Injection Profiles Along Horizontal; Asheim, Harald, Norwegian Institute of Technology: Ouderman, Pier, Koninkiije/Shell Exploratie on Producktie Laboratorium: SPE Drilling & Completion, vol. 12, No. 1, March; pp. 13-18; 1997 Society of Petroleum Engineers.

"Rapid Swelling and Deswelling of Thermoreversible Hydrophobically Modified Poly(N-Isopropylacryiamide) Hydrogels Prepared by Freezing Polymerisation", Xue, W., Hamley, I. W. and Huglin, M. B., 2002, 43(1) 5161-5186.

"Thermoreversible Swelling Behavior of Hydrogels Based on N-isopropylacrylamide with a Zwitterionic Comonomer", Xue, W., Champ, S. and Huglin, M. B 2001, European Polymer Journal. 37(5) 869-875.

Dinaryand, R., D'Emanuele, A (1995) The use of thermoresponsive hydrogels for on-off release of molecules, J. Control, Rel. 36: 221-227.

Tanaka, T., Nishio, I., Sun, S.Y., Ueno-Nisho, S. (1982) Collapse of gels in an electric field, Science. 216:467-469.

Ishihara, K., Hamada, N., Sato, S., Shinohara, I., (1984) Photoinduced serlling control of amphiphdillc azoaromatic polymer membrane. J. Polym. Sci., Polym Chem. Ed 22: 121-126.

Ricka, J. Tanaka, T. (1984) Swelling of Ionic gels: Quantitative performance of the Donnan Thory, Macromolecules. 17: 2916-2921.

Restarick, Henry, Halliburton Energy Services, SPE Member: SPE 29831 Horizontal Completion Options in Reservoirs With Sand Problems: Presented at the SPE Middle East Oil Show, Behrain, Mar. 11-14, 1995; Copyright 1995, Society of Petroleum Engineers, Inc.

Dikken, Ben J., SPE, Konninkijke/Shell E&P Laboratorium; Pressure Drop in Horizontal Well and Its Effect on Production Performance; Nov. 1990, JPT, Copyright 1990 Society of Petroleum Engineers; pp. 1426-1433.

Stephen P. Mathis, Baker Oil Tools, SPE; "Sand Management: A Review of Approaches and Concerns; SPE 82240"; Presented at the SPE European Formation Damage Conference, Hague, The Netherlands May 13-14, 2003; Copyright 2003, Society of Petroleum Engineers Inc.

E. Paul Bercegeay, University of Southwestern Louisiana; Charles A. Richard, Baker Oil Tools, Inc. Member AIME; "A One-Trip Gravel Packing System, SPE 4771"; Prepared for the Society of Petroleum Engineers of AIME Symposium on Formation Damage Control, New Orleans, La., Feb. 7-8, 1974; Copyright 1974, American Institute of Mining, Metallurigical and Petroleum Engineers, Inc.

* cited by examiner

FLOW CONTROL DEVICE UTILIZING A REACTIVE MEDIA

BACKGROUND OF THE DISCLOSURE

1. Field of the Disclosure

The disclosure relates generally to systems and methods for selective control of fluid flow into a production string in a wellbore.

2. Description of the Related Art

Hydrocarbons such as oil and gas are recovered from a subterranean formation using a wellbore drilled into the formation. Such wells are typically completed by placing a casing along the wellbore length and perforating the casing adjacent each such production zone to extract the formation fluids (such as hydrocarbons) into the wellbore. These production zones are sometimes separated from each other by installing a packer between the production zones. Fluid from each production zone entering the wellbore is drawn into a tubing that runs to the surface. It is desirable to have substantially even drainage along the production zone. Uneven drainage may result in undesirable conditions such as an invasive gas cone or water cone. In the instance of an oil-producing well, for example, a gas cone may cause an in-flow of gas into the wellbore that could significantly reduce oil production. In like fashion, a water cone may cause an in-flow of water into the oil production flow that reduces the amount and quality of the produced oil. Accordingly, it is desired to provide even drainage across a production zone and/or the ability to selectively close off or reduce in-flow within production zones experiencing an undesirable influx of water and/or gas.

The present disclosure addresses these and other needs of the prior art.

SUMMARY OF THE DISCLOSURE

In aspects, the present disclosure provides an apparatus for controlling a flow of a fluid into a tubular in a wellbore. In one embodiment, the apparatus may include a flow path associated with a production control device; an occlusion member positioned along the flow path that moves between a first position and a second position, the occlusion member being activated by a change in a pressure differential in the flow path; and a reactive media disposed along the flow path that changes a pressure differential across at least a portion of the flow path by interacting with a selected fluid to thereby actuate the occlusion member. The occlusion member may translate from the first position to the second position after the reactive media interacts with the selected fluid. In one aspect, the occlusion member may include a head portion that occludes a section of the flow path when the occlusion member is in the second position. In embodiments, the occlusion member may include an inner sleeve and an outer sleeve. A portion of the flow path may be defined by an annular space separating the inner sleeve and the outer sleeve. In some arrangements, the reactive media may be a water swellable material. In other arrangements, the reactive media may be an oil swellable material. Also, the reactive media may be selected or formulated to change a parameter related to the flow path. Illustrative parameters include, but are not limited to, (i) permeability, (ii) tortuosity, (iii) turbulence, (iv) viscosity, and (v) cross-sectional flow area.

In aspects, the present disclosure provides a method for controlling a flow of a fluid into a wellbore tubular in a wellbore. In embodiments, the method may include conveying the fluid via a flow path from the formation into a flow bore of the wellbore; positioning an occlusion member along the flow path; controlling a pressure differential in at least a portion of the flow path using a reactive material that interacts with a selected fluid; and moving the occlusion member between the first position and a second position when the selected fluid is in the flowing fluid. The moving may be performed, in part, by translating the occlusion member from the first position to the second position after the reactive media interacts with the selected fluid. In embodiments, the method may utilize applying a translating force to the occlusion member to move the occlusion member.

In aspects, the present disclosure provides a system for controlling a flow of a fluid from a formation into a wellbore tubular. The system may include a plurality of in-flow control devices positioned along a section of the wellbore tubular. Each in-flow control device may include an occlusion member and an associated reactive media disposed in a flow path in communication with a bore of the wellbore tubular. The reactive media may be configured to change a pressure differential across at least a portion of the flow path by interacting with a selected fluid. In one embodiment, each occlusion member may include a conduit, and wherein the associated reactive media is disposed in the conduit.

In aspects, the present disclosure further includes an apparatus for controlling a flow of a fluid along a flow path in a wellbore. In embodiments, the apparatus may include an occlusion member and a reactive media positioned along the flow path. The occlusion member may be configured to control flow in the flow path by selectively occluding the flow path; and a reactive media disposed along the flow path. The reactive media may be configured to change a pressure differential across at least a portion of the flow path by interacting with a selected fluid, the occlusion member being activated by the change in the pressure differential.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
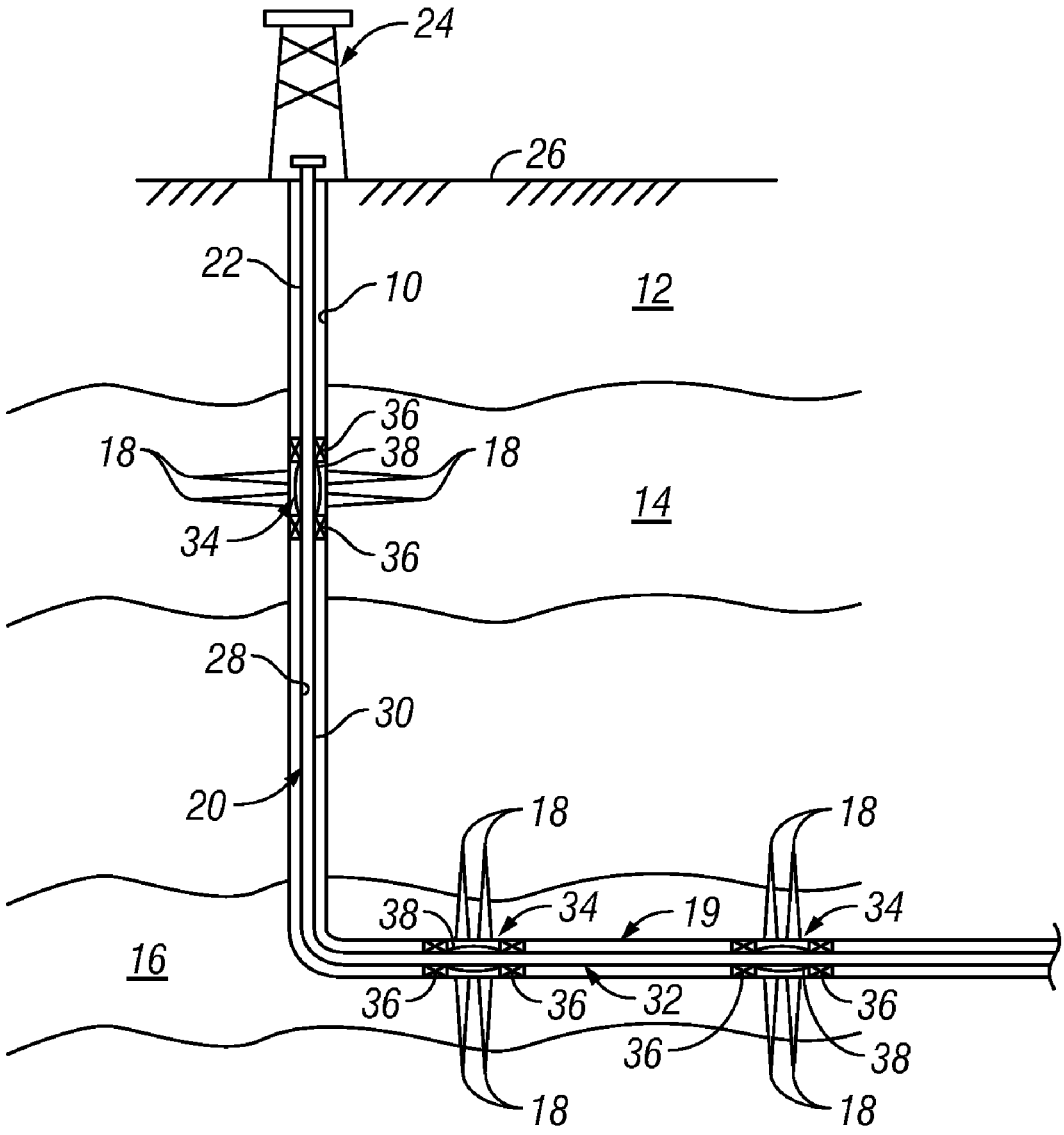
FIG. 1 is a schematic elevation view of an exemplary multi-zonal wellbore and production assembly which incorporates an in-flow control system in accordance with one embodiment of the present disclosure.

The present disclosure relates to devices and methods for controlling production of a hydrocarbon producing well. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein. Further, while embodiments may be described as having one or more features or a combination of two or more features, such a feature or a combination of features should not be construed as essential unless expressly stated as essential.

In one embodiment of the disclosure, in-flow of water into the wellbore tubular of an oil well is controlled, at least in part using an in-flow control element that contains a media that can interact with water in fluids produced from an underground formation and/or a fluid or other material introduced from the surface. The interaction varies a pressure differential across the in-flow control element, which applies an actuating force that may be used to translate or displace a member that restricts or blocks flow.

Referring initially to FIG. 1, there is shown an exemplary wellbore 10 that has been drilled through the earth 12 and into a pair of formations 14, 16 from which it is desired to produce hydrocarbons. The wellbore 10 is cased by metal casing, as is known in the art, and a number of perforations 18 penetrate and extend into the formations 14, 16 so that production fluids may flow from the formations 14, 16 into the wellbore 10. The wellbore 10 has a deviated, or substantially horizontal leg 19. The wellbore 10 has a late-stage production assembly, generally indicated at 20, disposed therein by a tubing string 22 that extends downwardly from a wellhead 24 at the surface 26 of the wellbore 10. The production assembly 20 defines an internal axial flowbore 28 along its length. An annulus 30 is defined between the production assembly 20 and the wellbore casing. The production assembly 20 has a deviated, generally horizontal portion 32 that extends along the deviated leg 19 of the wellbore 10. Production nipples 34 are positioned at selected points along the production assembly 20. Optionally, each production device 34 is isolated within the wellbore 10 by a pair of packer devices 36. Although only two production devices 34 are shown in FIG. 1, there may, in fact, be a large number of such production devices arranged in serial fashion along the horizontal portion 32.

Each production device 34 features a production control device 38 that is used to govern one or more aspects of a flow of one or more fluids into the production assembly 20. As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. Additionally, references to water should be construed to also include water-based fluids; e.g., brine or salt water. In accordance with embodiments of the present disclosure, the production control device 38 may have a number of alternative constructions that ensure selective operation and controlled fluid flow therethrough.

Figure 2:
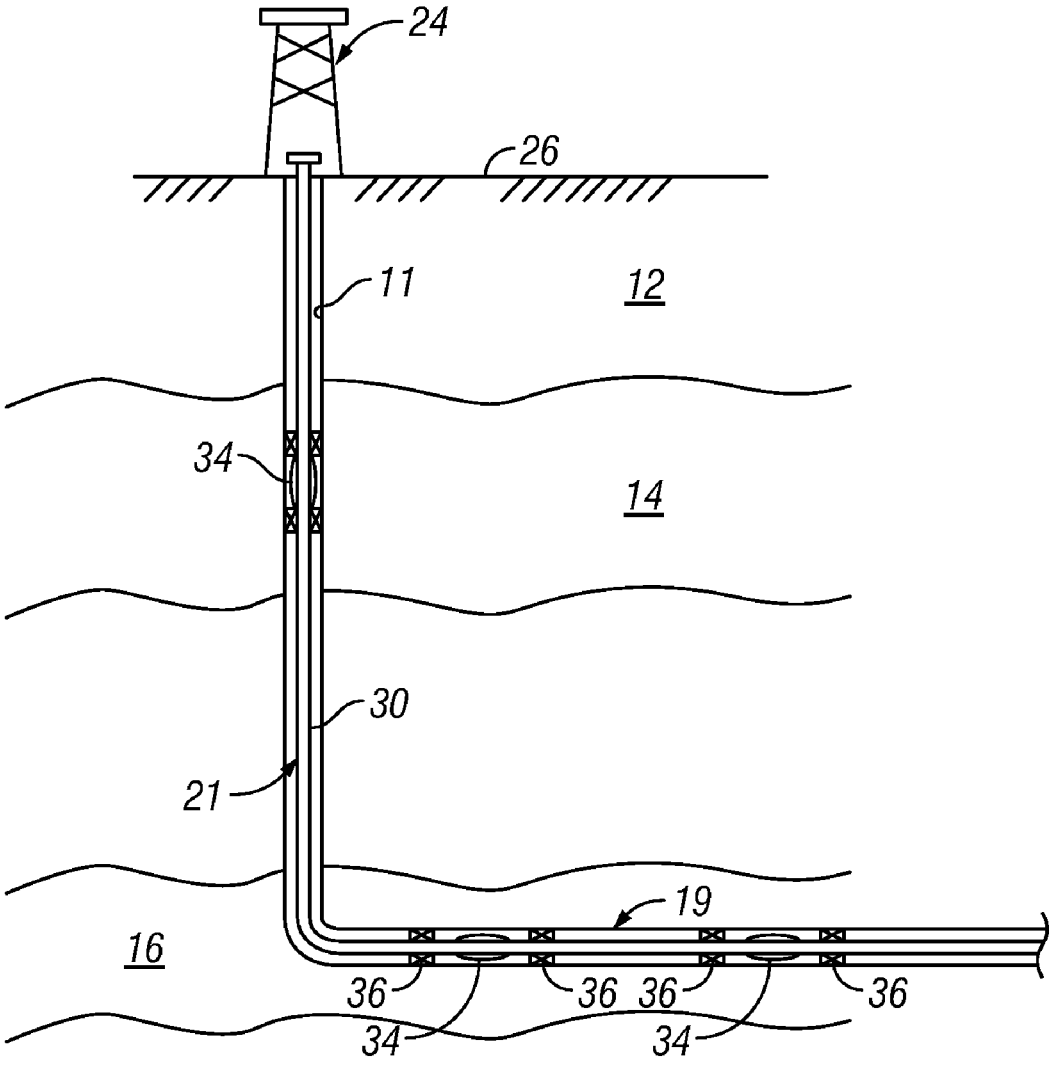
FIG. 2 is a schematic elevation view of an exemplary open hole production assembly which incorporates an in-flow control system in accordance with one embodiment of the present disclosure.

FIG. 2 illustrates an exemplary open hole wellbore arrangement 11 wherein the production devices of the present disclosure may be used. Construction and operation of the open hole wellbore 11 is similar in most respects to the wellbore 10 described previously. However, the wellbore arrangement 11 has an uncased borehole that is directly open to the formations 14, 16. Production fluids, therefore, flow directly from the formations 14, 16, and into the annulus 30 that is defined between the production assembly 21 and the wall of the wellbore 11. There are no perforations, and open hole packers 36 may be used to isolate the production control devices 38. The nature of the production control device is such that the fluid flow is directed from the formation 16 directly to the nearest production device 34, hence resulting in a balanced flow. In some instances, packers may be omitted from the open hole completion.

Figure 3:
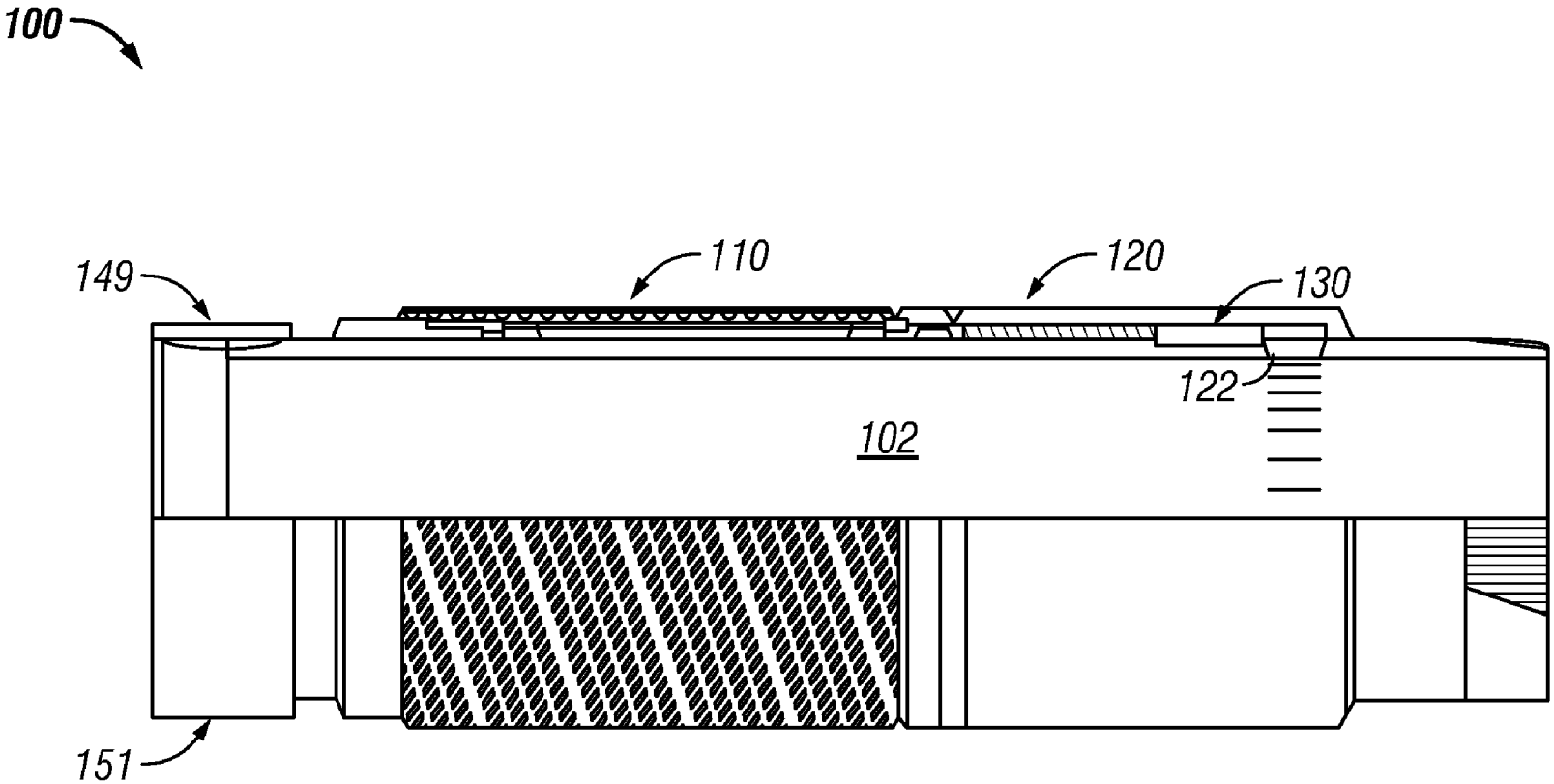
FIG. 3 is a schematic cross-sectional view of an exemplary in-flow control device made in accordance with one embodiment of the present disclosure.

Referring now to FIG. 3, there is shown one embodiment of a production control device 100 for controlling the flow of fluids from a reservoir into a flow bore 102 of a tubular 104 along a production string (e.g., tubing string 22 of FIG. 1). This flow control can be a function of one or more characteristics or parameters of the formation fluid, including water content, fluid velocity, gas content, etc. Furthermore, the control devices 100 can be distributed along a section of a production well to provide fluid control at multiple locations. This can be advantageous, for example, to equalize production flow of oil in situations wherein a greater flow rate is expected at a "heel" of a horizontal well than at the "toe" of the horizontal well. By appropriately configuring the production control devices 100, such as by pressure equalization or by restricting in-flow of gas or water, a well owner can increase the likelihood that an oil bearing reservoir will drain efficiently. Exemplary production control devices are discussed herein below.

The production control device 100 may include a particulate control device 110 for reducing the amount and size of particulates entrained in the fluids, a flow management device 120 that controls one or more drainage parameters, and an in-flow control device 130 that controls flow based on the composition of the in-flowing fluid. The particulate control device 110 can include known devices such as sand screens and associated gravel packs. The in-flow control device 120 includes one or more flow paths between a formation and a wellbore tubular that may be configured to control one or more flow characteristics such as flow rates, pressure, etc. For example, the in-flow control device 120 may utilize a helical flow path to reduce a flow rate of the in-flowing fluid. As will be described in greater detail below, the in-flow control device 130 may be actuated by a pressure-differential that is generated when a specified fluid, e.g., water, of a sufficient concentration or amount, is encountered by the production control device 100. While the flow control element 130 is shown downstream of the particulate control device 110 in FIG. 3, it should be understood that the flow control element 130 be positioned anywhere along a flow path between the formation and the flow bore 102. For instance, the in-flow control device 130 may be integrated into the particulate control device 110. Illustrative embodiments are described below.

Figure 4A:
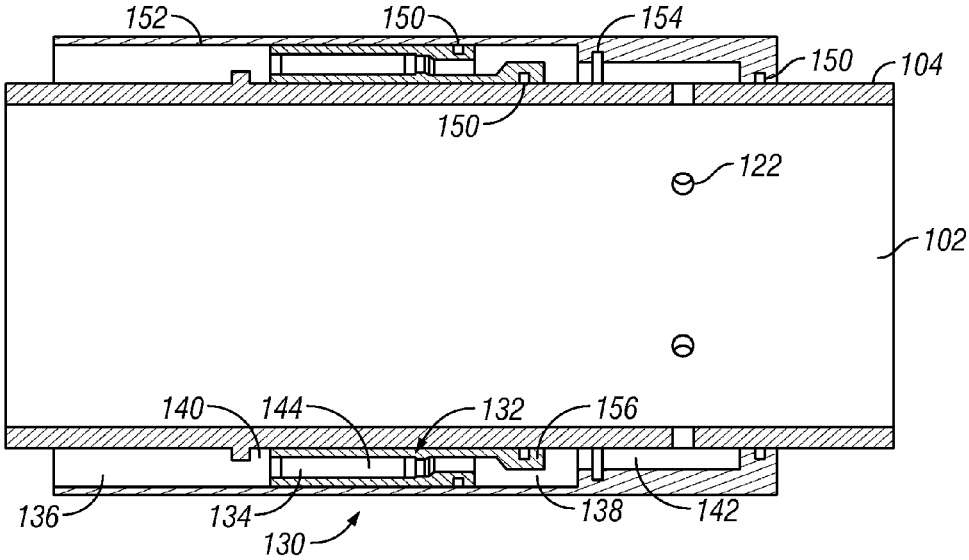
FIGS. 4A and 4B schematically illustrate an exemplary in-flow control device in accordance with one embodiment of the present disclosure.

Turning to FIG. 4A, there is shown an exemplary embodiment of an in-flow control device 130. In embodiments, the in-flow control device 130 may include a movable occlusion member 132 that incorporates a reactive media 134 along a flow path 136 of the fluid. The movable occlusion member 132 may be any structure that can slide, spin, rotate, translate or otherwise move between two or more positions. For simplicity, the movable occlusion member 132 will be described as a translating member or piston 132 that has a first position that permits flow and a second position wherein flow is partially or completely blocked. The media 134 may be configured to interact with one or more selected fluids in the inflowing fluid to either partially or completely block the flow of fluid into the flow bore 102. The piston 132 may be positioned in a chamber 138 that communicates with an inlet 140 and an outlet 142. The piston 132 may be configured to translate along the chamber 138 between an open position shown in FIG. 4A and a closed position shown in FIG. 4B. In one arrangement, the piston 132 includes a channel or conduit 144 in which the reactive media 134 is disposed. It should be appreciated that the conduit 144 is a portion of the flow path 136. Thus, in FIG. 4A, the fluid flows in via the inlet 140, along the channel 144, and exits through the outlet 142, which leads to the openings 122. The reactive media 134 is configured to control a pressure differential across the conduit 144 as a function of a composition of the flowing fluid. For example, in one embodiment, the reactive media 134 is a water swellable material, such as an elastomer, that increases in volume when exposed to water. When the fluid in the conduit 144 is mostly oil, the reactive media 134 is in an un-activated state, and generates a first pressure differential along the conduit 144. This pressure differential, however, does not apply a sufficient force to displace or move the piston 132. When the fluid in the conduit 144 has a predetermined amount of water, the reactive media 134 reacts by increasing in volume or swelling. This change in volume of the reactive media 134 changes one or more parameters of the conduit 144 in a manner that increases the pressure differential across the conduit 144. Once the increased pressure differential reaches a predetermined second pressure differential, the force applied by the second pressure differential moves the piston 132 into engagement with the outlet 142. Thus, the piston 132 may be considered as being actuated by the increased pressure differential induced or created by the reactive media 134.

In aspects, Darcy's Law may be used to determine the dimensions and other characteristics of the conduit 144, the piston 132, and the reactive media 134 that will cause the first and the second pressure differentials. As is known, Darcy's Law is an expression of the proportional relationship between the instantaneous discharge rate through a permeable medium, the viscosity of the fluid, and the pressure drop over a given distance:

$$Q = \frac{-\kappa A}{\mu} \frac{(P_2 - P_1)}{L}$$

where Q is the total discharge, K is permeability of the permeable medium, A is the cross-sectional flow area, $(P_2-P_1)$ is the pressure drop, μ is the viscosity of the fluid, and L is the length of the conduit. Because permeability, cross-sectional flow area, and the length of the conduit are characteristics of the in-flow control device 130, the in-flow control device 130 may be constructed to provide a specified pressure drop for a given type of fluid and flow rate.

Figure 4B:
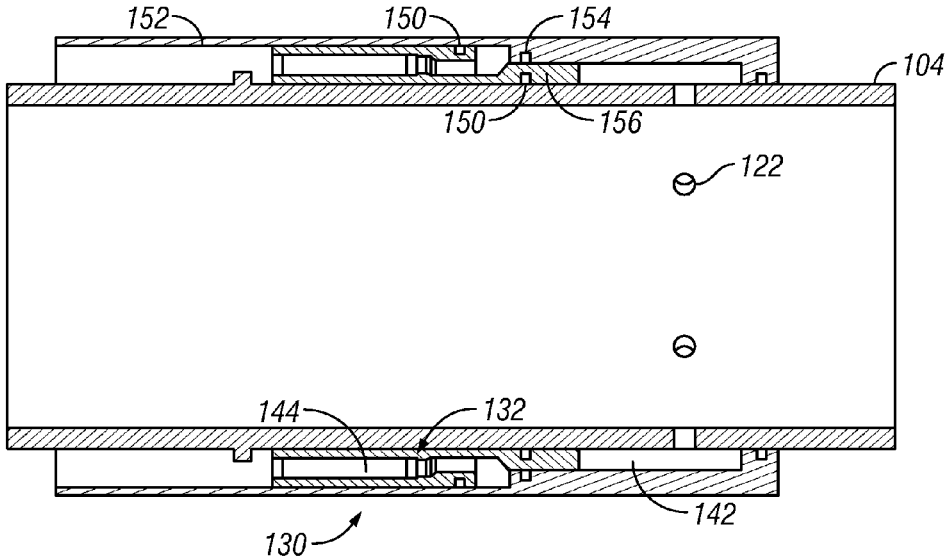

In order to confine flow through only the conduit 144, seals 150 may be positioned as needed to prevent fluid leaks between the piston 132 and a housing 152 of the flow control device 120 or the wellbore tubular 104. Additionally, a seal 154 may be positioned at the outlet 142 to primarily or secondarily block flow across the outlet 142. For example, as shown in FIG. 4B, the piston 132 may include a sealing head portion 156 that engages the seal 154. It should be appreciated that a barrier to flow formed by the seal 154 and head portion 156 may be relatively robust and provide a relatively long term (e.g., several years) sealing effect.

It should be understood that the piston 132, the reactive media 134 and the conduit 144 are susceptible to a variety of configurations. A few non-limiting configurations are discussed below.

Figure 5:
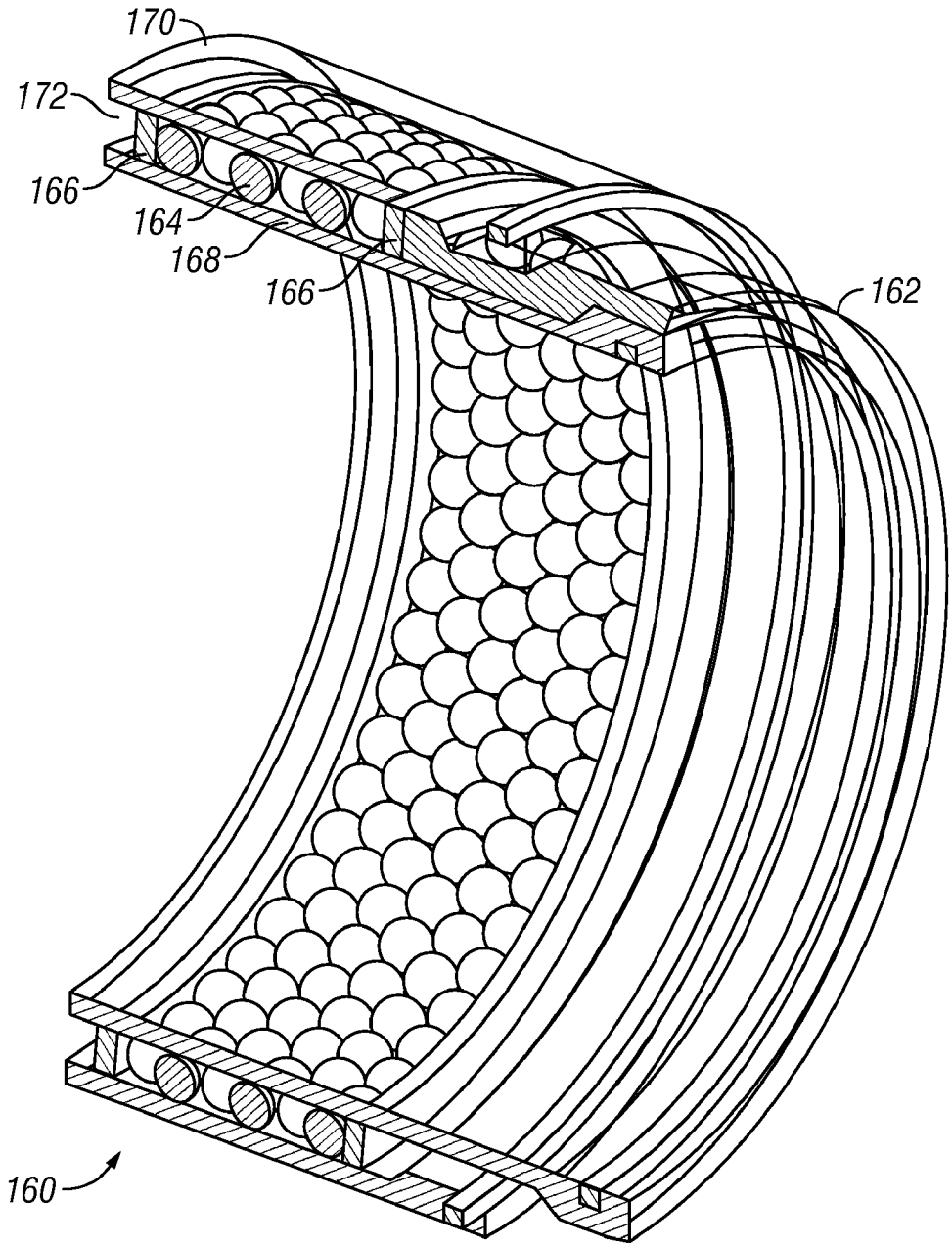
FIG. 5 schematically illustrates an isometric cross sectional view of an exemplary occlusion member in accordance with the present disclosure.

Referring now to FIG. 5, there is isometrically shown an in-flow control device 160 that includes a piston 162, a reactive media 164, and retention members 166. The piston 162 may include an inner sleeve 168 and an outer sleeve 170. The inner sleeve 168 may be configured to slide or seat on the production tubular 104 (FIG. 3). The retention members 166 may be configured as axially spaced-apart rings or annular members that may be fixed to the inner sleeve 168 and/or the outer sleeve 170. The reactive media 164 may utilize material formed as discrete elements such as foam, beads, balls, pellets, a perforated body, or particles that are disposed between the retention members 166 and within an annular space 172 between the inner sleeve 168 and the outer sleeve 170. The retention members 166 may be configured as permeable members that are sufficiently rigid to confine the reactive media 164 but also sufficiently permeable to not impede the flow of fluid. Exemplary structures may include perforated walls, filters, screens or mesh walls. The reactive media 164 may be formed of water swellable elastomers that expand in volume when exposed to water. Thus, it should be appreciated that when the reactive media 164 is in an un-activated state, a first set of parameters or characteristics that influence a pressure differential exist in the annular space 172. When the reactive media 164 is exposed to and activated by water, the increased volume of the reactive media 164 causes a change in one or more parameters or characteristics in a manner that causes the pressure differential in the annular space 172 to increase. Thus, the pressure differential across the piston 162 increases. When of a sufficient magnitude, the force applied by the pressure differential will translate the piston 162.

Figure 6A:
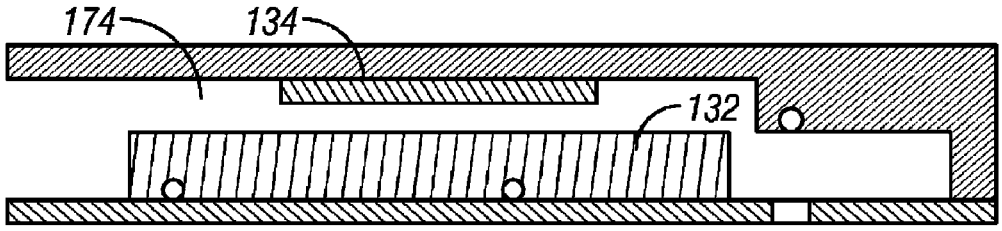
FIGS. 6A and 6B are schematic cross-sectional views of an embodiment of an occlusion member in accordance with the present disclosure that utilizes an external reactive media.
Figure 6B:
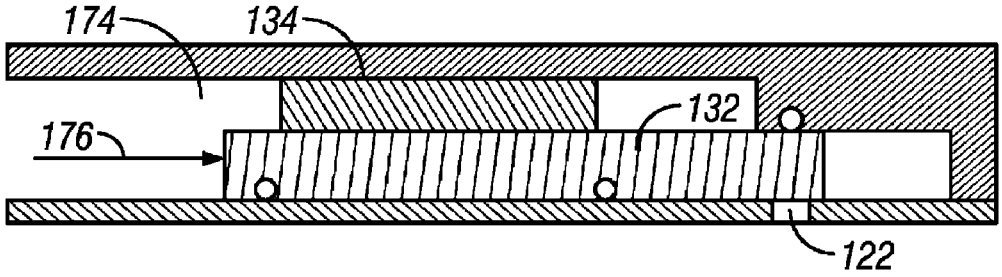

The reactive media need not be integrated within an occlusion member in order to vary the pressure differential applied to that occlusion member. Referring now to FIGS. 6A-B, there are shown reactive media 134 that is positioned external to an occlusion member 132. The reactive media 134 may be disposed in a flow path 174 that runs parallel to the occlusion member 132. It should be appreciated that the flow path 174 may be a portion of the flow path 136 of FIG. 4A. As shown, the reactive media 134 may be formed as a solid material that expands to reduce the area of the flow path 174. In other embodiments, the reactive media 134 may be formed in any of the configurations described with reference to the reactive media 164 of FIG. 5. Referring to FIG. 6B, when activated by a selected material such as water, the reactive media 134 may generate an increased pressure differential applied to the occlusion member 132. That is, the reactive media 134 may change the cross-sectional flow area, permeability, tortuosity, or other parameter or characteristic of the flow path 174 in such a manner that permits the increased pressure differential to apply a translating force 176 to the occlusion member 132. The translating force 176 slides the occlusion member 132 into a sealing engagement with the opening 122.

It should be appreciated that the in-flow control device 130 may utilize any of a number of configurations and methodologies to vary the pressure differential applied to the occlusion member 132. As shown in FIGS. 4A, 4B and 5, the expansion of the reactive media disposed in a conduit may influence one or more parameters or characteristics that affect a pressure differential across the conduit. For example, the expansion of the reactive media may reduce permeability across the conduit, increase a surface area that applies frictional or drag forces to the flowing fluid, increase the tortuosity of the conduit, reduce a cross-sectional area of the conduit, increase turbulence in the flowing fluid, etc.

Figure 6C:
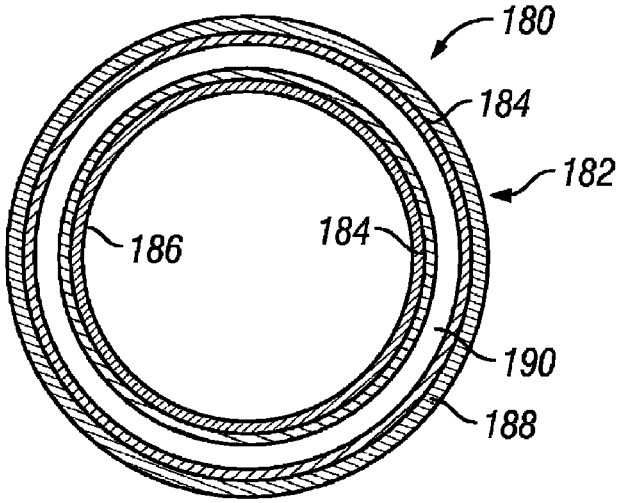
FIGS. 6C and 6D are schematic cross-sectional views of an embodiment of an occlusion member in accordance with the present disclosure wherein a reactive media changes a cross-sectional flow area.
Figure 6D:
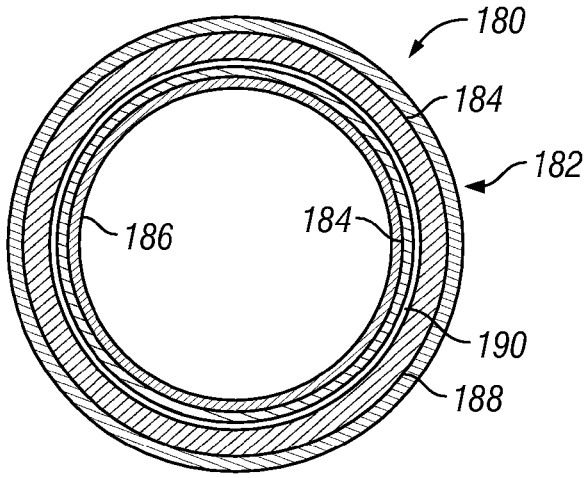

Referring now to FIGS. 6C and 6D, there is shown in cross-sectional schematic form a variant of an in-flow control device 180 that varies a cross-sectional flow area to control a pressure differential across a conduit. The in-flow control device 180 may include a piston 182, and reactive media 184. The piston 182 may include an inner sleeve 186 and an outer sleeve 188 that are separated by an annular space 190. The reactive media 184 may be formed as a coating or sleeve coupled to an outer surface of the inner sleeve 186 and/or an inner surface of an outer sleeve 188. In the un-activated state shown in FIG. 6A, the annular space 190 may have a first cross-sectional flow area that is sufficiently large so as to not generate a pressure differential that could displace or translate the piston 182. In FIG. 6D, the reactive media 184 has been activated by water, which causes the annular space 190 to have a second smaller cross-sectional flow area, which may create a pressure differential of sufficient magnitude to translate the piston 182.

Figure 6E:
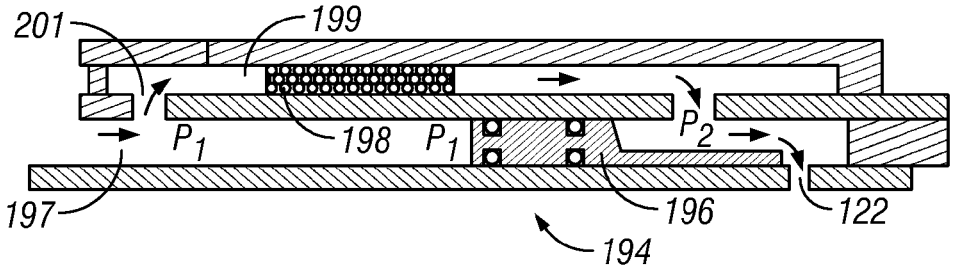
FIG. 6E is schematic cross-sectional view of an embodiment of an occlusion member in accordance with the present disclosure wherein a reactive media structurally separated from the occlusion member.

Referring now to FIG. 6E, there is shown an embodiment of an in-flow control device 194 wherein the occlusion member 196 is positioned at a location separate from the reactive media 198. The occlusion member 196 and the reactive media 198 are in pressure communication with a common fluid flow 197. As shown, the reactive media 198 is positioned axially spaced apart from the occlusion member 196 and receives a separate fluid stream 199 via the juncture 201 along the common fluid flow 197. In other embodiments, the reactive media 198 may be positioned external to the production control device 100 (FIG. 3) such as in a wellbore annulus. The reactive media 198 in such applications may be hydraulically coupled to the juncture 201 using a hose, tube, pipe or other such device that is configured to transmit pressure. In an un-activated state, the reactive media 198 establishes a pressure differential between the juncture 201 and the opening 122 that does not generate a translating force of sufficient magnitude to displace the occlusion member 196. When activated, the reactive media 198 increases the pressure differential between the juncture 201 and the opening 122 such that the pressure differential generates a force sufficient to displace the occlusion member 196 and move the occlusion member 196 into sealing engagement with the opening 122.

It should be appreciated that the in-flow control devices of the present disclosure may utilize certain features that may provide enhanced control over fluid in-flow. For example, the risk of inadvertent or undesirable actuation of the in-flow device 130 of FIG. 3 may be reduced by utilizing a locking device that arrests movement of the piston 132 until a minimum differential pressure threshold is reached. Suitable locking devices include, but are not limited to, collets, shear rings, and shear screws etc. Also, a device such as a screen that prevents passage of specifically sized solid may also be incorporated into a piston.

Additionally, the reactive media 134 may be selected or formulated to react or interact with materials other than water. For example, the reactive media 134 may react with hydrocarbons, chemical compounds, particulates, gases, liquids, solids, additives, chemical solutions, mixtures, etc. For instance, the reactive media may be selected to increase rather than decrease permeability, which would decrease a pressure differential. One material for such an application may be a dissolving material. Another suitable material may reduce or oxidize upon contact with water or other substance. Thus, in aspects, materials suitable for such an application may dissolve, oxidize, degrade, disintegrate, etc. upon contact with a selected fluid such as water, oil, etc.

In still further variants, devices according to the present disclosure may be actuated to perform a desired action in a wellbore by pumping into the well a fluid having a selected material. It should be appreciated that flow parameters such as pressure or circulation rate would not necessarily have to be adjusted to actuate such a device. Rather, a "pill" of fluid may be conveyed into the wellbore to activate a reactive media. Thus, mechanical intervention, dropping a ball, using a flow-sensitive switch, deploying an actuating device via coiled tubing, jointed pipe, wireline or slick, etc., may not be needed.

Also, in certain production-related applications, a piston using an oil swellable reactive media may be used to actuate or operate a valve device. The oil swellable reactive media would be in an non-activated state while fluids such as drilling fluid, water, acids, fracturing fluids, and other such fluids are circulated in the wellbore. However, once hydrocarbons are produced, the oil swellable reactive media would be activated.

It should be appreciated that the teachings of the present disclosure may be advantageously applied to situations and operations outside of the oil well production. For example, drilling systems, milling tools, formation evaluation tools, and other types of equipment may also be configured to be actuated by selective generation of pressure differentials.

Figure 7:
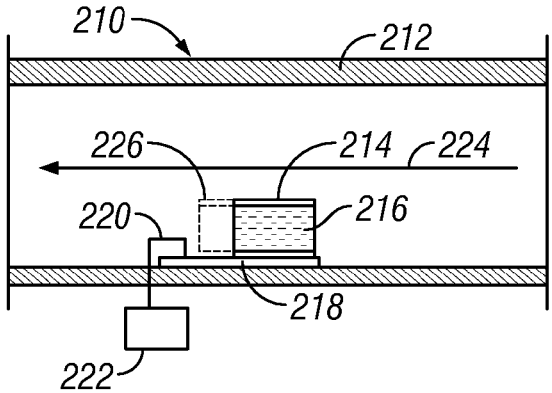
FIG. 7 is a schematic cross-sectional view of a flow monitoring device made in accordance with one embodiment of the present disclosure.

Referring now to FIG. 7, there is schematically illustrated one embodiment of a device 210 that may be actuated by selective generation of a pressure differential. The device 210 may be positioned in a tubular 212 through which a fluid such as liquids or gases is conveyed. The tubular 212 may be a subsea flow line, a surface pipe line, or any other conduit for conveying fluids. In one application, it may be desirable to monitor whether a particular element, e.g., H2S, is present in the flowing fluid. Thus, the device 210 may include an enclosure 214 that receives a reactive media 216. The reactive media 216 may be a material that swells or deforms when exposed to a selected element. The enclosure 214 may be configured to translate or slide along a track 218 that has a switch 220 at one end of travel. The switch 220 may be an electrical device or a mechanical device, e.g., a trigger or trip-type mechanism. The switch 220 may be operatively coupled to a monitoring device 222 that may be configured to record data, transmit signals, activate an alarm, etc. In one mode of operation, a fluid 224 flowing in the tubular 212 may initially have little or no amount of the selected element. Thus, the fluid 224 flowing through the enclosure 214 does not generate a pressure differential sufficient to translate the enclosure 214. When the selected element is present in the fluid 224, the reactive media 216 expands to restrict fluid flow. Thus, the flowing fluid 224 may generate a higher pressure differential across the enclosure 214. Once the force applied by the higher pressure differential is of sufficient magnitude, the enclosure 214 translates or moves to a second position 226, which is shown in dashed lines, and engages the switch 220. The switch 220 activates the monitoring device 222, which may take any number of responsive actions.

It should be understood that FIGS. 1 and 2 are intended to be merely illustrative of the production systems in which the teachings of the present disclosure may be applied. For example, in certain production systems, the wellbores 10, 11 may utilize only a casing or liner to convey production fluids to the surface. The teachings of the present disclosure may be applied to control flow through these and other wellbore tubulars.

From the above, it should be appreciated that what has been described includes, in part, an apparatus for controlling a flow of a fluid into a wellbore tubular in a wellbore. In one embodiment, the apparatus may include a flow path associated with a production control device and an occlusion member positioned along the flow path. The occlusion member may be configured to move between a first position and a second position. The apparatus may also include a reactive media disposed along the flow path. The reactive media may be configured to change a pressure differential across at least a portion of the flow path by interacting with a selected fluid. The occlusion member may translate from the first position to the second position after the reactive media interacts with the selected fluid. The interaction may increase a pressure differential applied to the occlusion member that moves or otherwise displaces the occlusion member. The reactive media may increase the pressure differential by changing a parameter related to the flow path. Illustrative parameters include, but are not limited to, (i) permeability, (ii) tortuosity, (iii) turbulence, (iv) viscosity, and (v) cross-sectional flow area.

From the above, it should also be appreciated that what has been described includes, in part, a method for controlling a flow of a fluid into a wellbore tubular in a wellbore. In embodiments, the method may include conveying the fluid via a flow path from the formation into a flow bore of the wellbore; positioning an occlusion member along the flow path; controlling a pressure differential in at least a portion of the flow path using a reactive material that interacts with a selected fluid; and moving the occlusion member between the first position and a second position when the selected fluid is in the flowing fluid. The moving may be performed, in part, by translating the occlusion member from the first position to the second position after the reactive media interacts with the selected fluid. In embodiments, the method may utilize applying a translating force to the occlusion member to move the occlusion member.

From the above, it should be appreciated that what has been described includes, in part, a system for controlling a flow of a fluid from a formation into a wellbore tubular. The system may include a plurality of in-flow control devices positioned along a section of the wellbore tubular. Each in-flow control device may include an occlusion member and an associated reactive media disposed in a flow path in communication with a bore of the wellbore tubular. The reactive media may be configured to change a pressure differential across at least a portion of the flow path by interacting with a selected fluid. In one embodiment, each occlusion member may include a conduit, and wherein the associated reactive media is disposed in the conduit.

For the sake of clarity and brevity, descriptions of most threaded connections between tubular elements, elastomeric seals, such as o-rings, and other well-understood techniques are omitted in the above description. Further, terms such as "slot," "passages," "conduit," "opening," and "channels" are used in their broadest meaning and are not limited to any particular type or configuration. The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

What is claimed is:

1. An apparatus for controlling a flow of a fluid between bore of a tubular in a wellbore, comprising:

a flow path associated with a production control device, the flow path configured to convey the fluid from the formation into a flow bore of the wellbore tubular;

an occlusion member positioned along the flow path, the occlusion member being configured to move between a first position and a second position to control flow along the flow path; and a reactive media disposed along the flow path, the reactive media being configured to restrict the fluid flow upon interacting with a selected fluid, the occlusion member being actuated by the change in the restriction of fluid flow.

2. The apparatus of claim 1 wherein the reactive media translates the occlusion member from the first position to the second position after the reactive media interacts with the selected fluid and reduces a cross sectional flow area of the flow space fluid.

3. The apparatus of claim 1 further comprising a housing in which the flow path is formed, the reactive media being positioned along the flow path in the housing and wherein the occlusion member includes a head portion that occludes a section of the flow path when the occlusion member is in the second position.

4. The apparatus of claim 1 wherein the occlusion member includes an inner sleeve and an outer sleeve, wherein the reactive media is positioned between the inner sleeve and the outer sleeve, and wherein a portion of the flow path is through the reactive media.

5. The apparatus of claim 1 wherein the reactive media is a water swellable material.

6. The apparatus of claim 1 wherein the reactive media is an oil swellable material.

7. The apparatus of claim 1 wherein the reactive media changes a parameter related to the flow path, the parameter being selected from a group consisting of: (i) permeability, (ii) tortuosity, (iii) turbulence, (iv) viscosity, and (v) cross-sectional flow area.

8. A method for controlling a flow of a fluid into a tubular in a wellbore, comprising:

conveying the fluid via a flow path from the formation into a flow bore of the wellbore;

positioning an occlusion member along the flow path;

restricting the flow path using a reactive material that interacts with a selected fluid; and moving the occlusion member between the first position and a second position using an increase in a pressure differential in the flowing fluid caused by the restriction of the flow path.

9. The method of claim 8 further comprising flowing the fluid through the reactive media and wherein the moving includes translating the occlusion member from the first position to the second position using the reactive media after the reactive media interacts with the selected fluid.

10. The method of claim 8 wherein the occlusion member includes a head portion, and further comprising occluding a section of the flow path with the head portion when the occlusion member is in the second position.

11. The method of claim 8 further comprising forming the flow path in a housing, positioning the reactive media along the flow path in the housing, and applying a translating force to the occlusion member to move the occlusion member.

12. The method of claim 8 wherein the reactive media is a water swellable material.

13. The method of claim 8 wherein the reactive media is an oil swellable material.

14. The method of claim 8 further comprising changing a parameter related to the flow path using the reactive media, the parameter being selected from a group consisting of: (i) permeability, (ii) tortuosity, (iii) turbulence, (iv) viscosity, and (v) cross-sectional flow area.

15. A system for controlling a flow of a fluid from a formation into a wellbore tubular, comprising:

a plurality of in-flow control devices positioned along a section of the wellbore tubular, each in-flow control device including an occlusion member and an associated reactive media disposed in a flow path in communication with a bore of the wellbore tubular, the reactive media being configured to change a pressure differential across at least a portion of the flow path by interacting with a selected fluid, each occlusion member being actuated by the change in the pressure differential in the fluid flowing in the flow path.

16. The system of claim 15 wherein the reactive material is configured to have the fluid flow therethrough and wherein reactive media translates each associated occlusion member from the first position to the second position after the associated reactive media interacts with the selected fluid.

17. The system of claim 15 further comprising a housing in which the flow path is formed, the reactive media being positioned along the flow path in the housing and wherein each occlusion member includes a head portion that occludes a section of the flow path when the occlusion member is in the second position.

18. The system of claim 15 wherein each occlusion member includes a conduit, and wherein the associated reactive media is disposed in the conduit, the reactive media being configured to allow flow therethrough.

19. The system of claim 15 wherein the reactive media is a water swellable material.

20. The system of claim 15 wherein the reactive media is an oil swellable material.

21. An apparatus for controlling a flow of a fluid along a flow path in a wellbore, comprising:

an occlusion member positioned along the flow path, the occlusion member being configured to control flow in the flow path by selectively occluding the flow path; and a reactive media disposed along the flow path, the reactive media being configured to change a pressure differential across at least a portion of the flow path by interacting with a selected fluid, the occlusion member being actuated by the change in pressure of the fluid flowing in the flow path.

* * * * *